US007438487B2

(12) United States Patent
Sugiyama et al.

(10) Patent No.: US 7,438,487 B2
(45) Date of Patent: Oct. 21, 2008

(54) PRINTING METHOD AND PRINTING PROGRAM

(75) Inventors: Jun Sugiyama, Nagano-ken (JP); Teruhito Kojima, Nagano-ken (JP); Masahiro Hara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 11/353,062

(22) Filed: Feb. 14, 2006

(65) Prior Publication Data

US 2006/0192989 A1 Aug. 31, 2006

(30) Foreign Application Priority Data

Feb. 18, 2005 (JP) ..... 2005-041749
Feb. 18, 2005 (JP) ..... 2005-041750
Feb. 18, 2005 (JP) ..... 2005-041751

(51) Int. Cl.
*B41J 11/00* (2006.01)

(52) U.S. Cl. ..... 400/613.2; 400/619

(58) Field of Classification Search ..... 400/613.2, 400/619, 626
See application file for complete search history.

(56) References Cited

U.S. PATENT DOCUMENTS 5,659,846 A * 8/1997 Yoshioka ..... 399/85
6,928,929 B1 * 8/2005 McNeil ..... 101/226
2003/0227652 A1 * 12/2003 Masaki ..... 358/1.18
2006/0182484 A1 * 8/2006 Xie et al. ..... 400/619

FOREIGN PATENT DOCUMENTS

JP 57105376 A * 6/1982
JP 10-293505 A 11/1998
JP 2000025286 A * 1/2000

* cited by examiner

*Primary Examiner*—Minh H Chau
(74) *Attorney, Agent, or Firm*—Sughrue Mion, PLLC

(57) ABSTRACT

In printing onto a creased paper with a fold portion, a printing method of the invention performs a warning step (S203) that gives a warning about the need of smoothening out of the fold portion; and a printing step that starts printing after the warning is given in the warning step. The printing method further performs a reception step (S204, S206) that receives a confirmation instruction with respect to the warning given in the warning step, and the printing step does not start printing until the confirmation instruction is received in the reception step.

5 Claims, 13 Drawing Sheets

PRINTING METHOD AND PRINTING PROGRAM

BACKGROUND OF THE INVENTION

1. Field of the Invention

This invention relates to a printing method and a printing program for printing onto creased paper.

2. Description of the Prior Art

With the diversification of printing and improvement of printing quality in recent years, there has been a demand for making original book covers. Since a book cover is normally used to cover a book or other printed matter, strong durability is required and in terms of paper quality, a paper that is rather thick and exhibits a strong repulsive force against bending, in other words, has stiffness is preferable to be used. A book cover paper can thus be fitted to printed matter readily and yet in a manner that is pleasing to the eye by being subject in advance to a creasing to the size and shape of the printed matter. Creasing refers to a process of forming folds to make a paper foldable readily by pressure, etc.

In general, a conventional printer performs printing by moving a head in a main scanning direction while feeding a paper in a sub scanning direction and thus has a paper feeding mechanism. Since a paper feeding mechanism normally feeds a paper in the sub scanning direction by rotating a plurality of rollers, etc., the paper which is to be printed on is preferably flat without any folds, etc. Printing onto a book cover or other paper that has been creased in advance was thus not considered.

However, in using the conventional printer, when printing is started onto an original book cover, such as that described above, with folded portions as they are, the folded portions of the paper become close in distance to the head and the paper thus causes so-called head rubbing, which leads to lowering of image quality. Furthermore, depending on the degree of folding of the folded portions of the paper, the head that moves in the main scanning direction may collide with the paper. Such collision may cause not just damage in the paper but may also cause damage of the collided head itself since, as mentioned above, paper that is thick and highly strong in terms of paper quality is used.

Also in some printer models of the conventional printer cannot perform such printing onto an original book cover, such as that described above, because the printing range is too long with respect to the sub scanning direction in comparison to a normal, regular paper. That is, skewing (oblique deviation of the paper with respect to a paper feeding direction) due to a long length of a paper occurs during printing at a rear end of a book cover paper or other paper of long length that is not supported at either end, unlike a roll paper which, though being long in length, is supported by a roll at one end. Printing onto such paper is thus prohibited in some cases to prevent the degradation of printing quality or to prevent unwanted paper jam. Also in using the conventional printer to print onto an original book cover paper, shortage of the memory capacity may occur due to an increase in the data quantity. It is thus considered that there exist models with which printing across a range that far exceeds that of a regular paper is prohibited as an inherent specification.

Furthermore, in using the conventional printer to print onto an original book cover, because the printing range is too long with respect to the sub scanning direction in comparison to a normal regular paper, skewing occurs more readily than in printing onto single sheets due to inadequate pressing by roller pressure. It is also considered that tension cannot be applied readily as in the case of a roll paper.

SUMMARY OF THE INVENTION

In order to remove at least one of the above drawbacks, the present invention is constructed as follows.

The present invention is directed to a first printing method of printing onto a creased paper with a fold portion, which includes a warning step that gives a warning about the need of smoothening out of the fold portion and a printing step that starts printing after the warning is given in the warning step.

The first printing method of the invention prevents in advance the feeding of a paper in a state in which the paper is folded at the fold portion, when a creased paper with a fold portion is used to print on.

The first printing method may further include a reception step that receives a confirmation instruction with respect to the warning given in the warning step, and the printing step may start printing after the confirmation instruction is received in the reception step. The first printing method with this structure more adequately prevents the feeding of a paper in a state in which the paper is folded at the fold portion, when a creased paper with a fold portion is used to print on.

In the first printing method of the invention, the creased paper may be a cover for printed matter. Printing onto a cover for printed matter is performed using a general printer.

The first printing method of the invention may further include a judging step that judges whether or not creased paper is selected as a printing paper to print on, and the warning step may give the warning about the need of smoothening out of the fold portion when the judging step judges that creased paper is selected as the printing paper. The first printing method of this structure avoids giving an unnecessary warning about the need of smoothing out of the fold portion in case where the warning is unnecessary.

The present invention is also actualized as a printing program that makes a computer execute the first printing method described above.

The present invention is also directed to a second printing method of printing onto a creased paper with a fold portion, including: an acquiring step that acquires information concerning the creasing of the creased paper; a first printing step that starts printing onto the paper and stops the printing at a predetermined creased position (referred to hereinafter as the "first position") based on the information acquired in the acquiring step; and a first paper discharging step that discharges the paper.

The second printing method of the invention allows for printing onto a creased paper with a printer with specification that prohibits printing across a range exceeding that of a regular paper. Even with such a printer, the printing onto a creased paper can be performed by setting the first position so that the range up to the first position does not exceed the range of a regular paper.

In the second printing method of the invention, the creased paper may be a cover for printed matter and has a left cover end leaf, a left cover, a back cover, a right cover, and a right cover end leaf, and the first position may be a boundary between the right (or left) cover and the right (or left) cover end leaf of the paper. Printing onto a cover for printed matter can be performed using a general printer, at least with respect to the left cover, the back cover, and the right cover of the cover.

In one preferable embodiment, the second printing method of the invention further includes a paper feeding step that feeds the paper to a predetermined creased position (referred to hereinafter as the "paper feeding ending position") that is set to be at the front side in the paper feeding direction with respect to the first position, based on the information acquired in the acquiring step. The first printing step starts printing after the paper is fed by the paper feeding step. The second printing method of this structure avoids performing printing in a range at the front side of the paper feeding direction in correspondence to a non-printed range at the rear side in the paper feeding direction.

In this embodiment, the creased paper may be a cover for printed matter and has a left cover end leaf, a left cover, a back cover, a right cover, and a right cover end leaf, and the paper feeding ending position may be a boundary between the left (or right) cover end leaf and the left (or right) cover of the paper. Printing onto a cover for printed matter can be performed using a general printer, at least with respect to the left cover, the back cover, and the right cover of the cover.

In another preferable embodiment, the second printing method of the invention may further include: a second printing step that starts printing on the paper which is set in reverse after the paper is discharged in the first paper discharging step and stops the printing at a predetermined creased position (referred to hereinafter as the "second position") based on the information acquired in the acquiring step; and a second paper discharging step that discharges the paper. This structure allows for printing on a paper that is long in the feeding direction.

In this embodiment, the second printing step may print remaining data, which have not been printed in the first printing step, after the remaining data are subject to a reversal process of a 180° rotation.

In this embodiment, the second printing method of the invention may further include a notifying step that notifies the need of reverse setting of the paper prior to the starting of printing by the second printing step. Thus, a user is encouraged to set the paper in the reverse way.

In this embodiment, the creased paper may be a cover for printed matter and has a left cover end leaf, a left cover, a back cover, a right cover, and a right cover end leaf, and the first position may be a boundary between the left (or right) cover and the back cover of the paper and the second position is a boundary between the right (or left) cover and the back cover of the paper. Printing onto a cover for printed matter can be performed using a general printer.

In this embodiment, furthermore, the first position and the second position may be the same position. In this case, the creased paper may be a cover for printed matter and has a left cover end leaf, a left cover, a back cover, a right cover, and a right cover end leaf, and the first position may be a boundary between the left (or right) cover and the back cover of the paper. Printing can be performed without clearance on a cover for printed matter.

The present invention is also actualized as a printing program that makes a computer execute the second printing method described above.

DESCRIPTION OF THE PREFERRED EMBODIMENTS

Preferred embodiments of a printing method and a printing program of the invention shall now be described with reference to the drawings.

First Embodiment

Details of a Creased Paper

Figure 1:
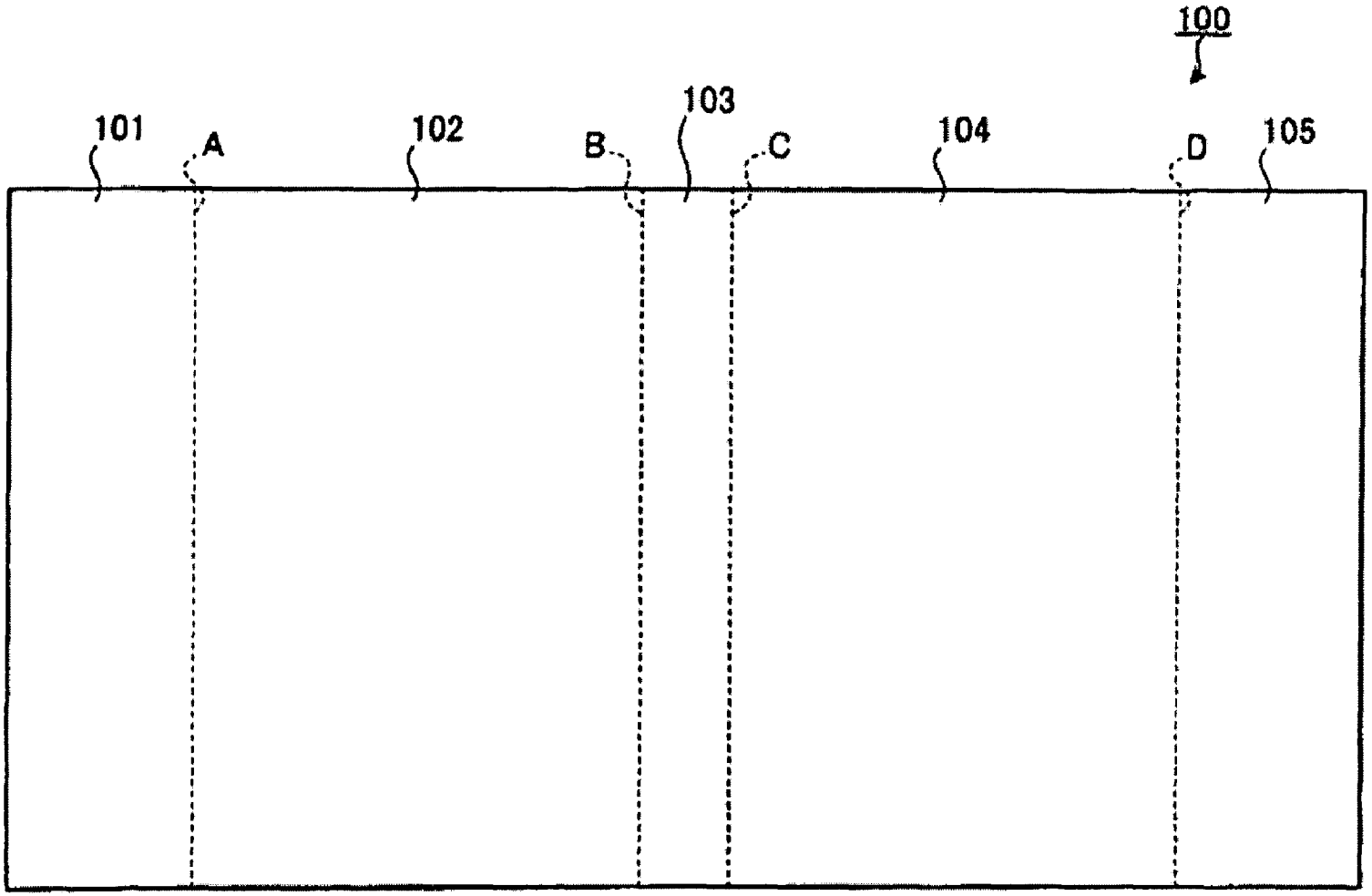
FIG. 1 is an explanatory diagram of details of a creased paper of an embodiment of the invention.
Figure 2:
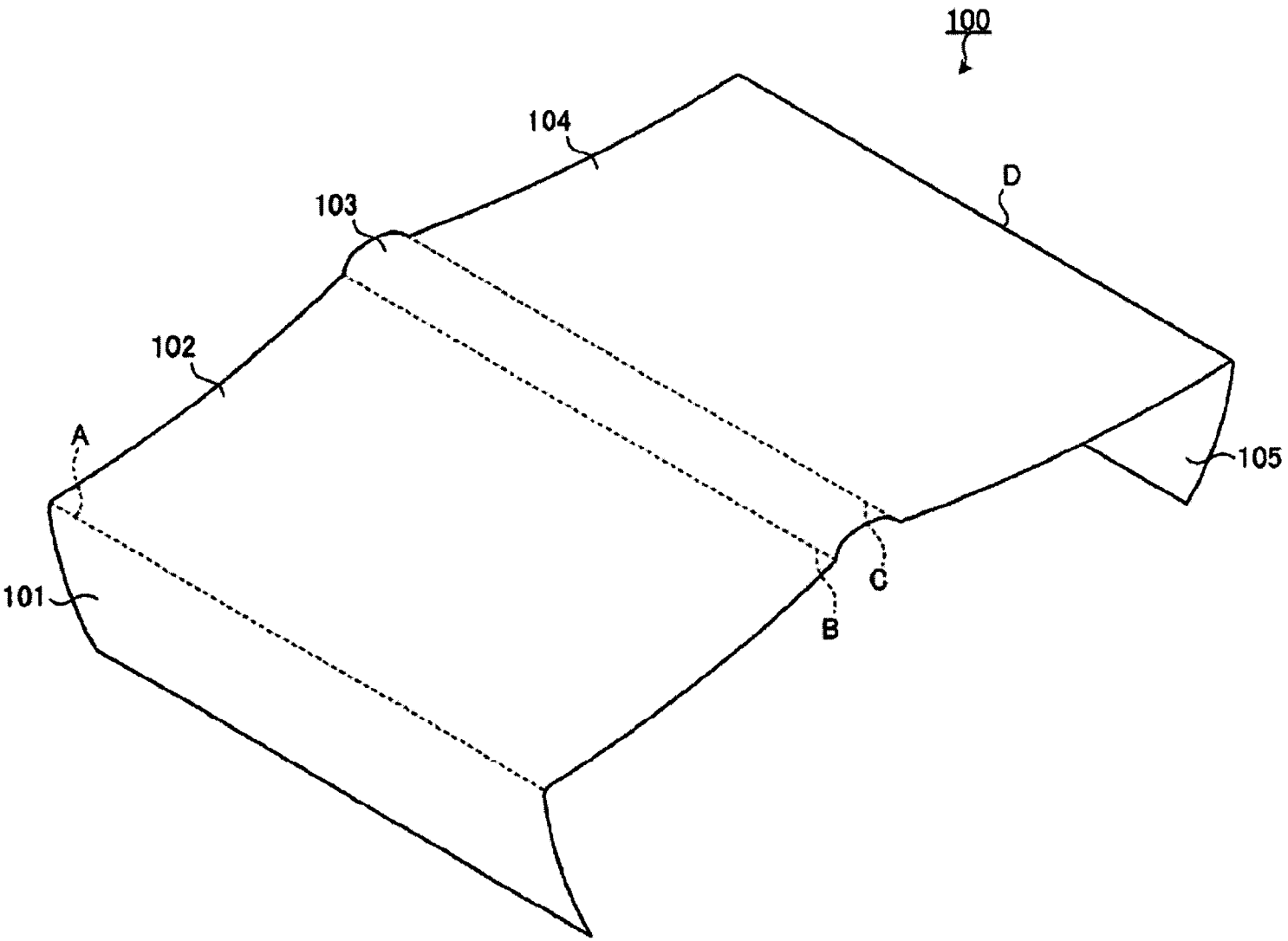
FIG. 2 is an explanatory diagram of details of the creased paper related to the embodiment.

FIG. 1 and FIG. 2 are explanatory diagrams of details of a creased paper related to an embodiment of this invention. In FIG. 1, a creased paper (referred to hereinafter simply as "paper") 100 has a left cover end leaf 101, a left cover 102, a back cover 103, a right cover 104, and a right cover end leaf 105. Creasing is applied in advance to a boundary A between left cover end leaf 101 and left cover 102, a boundary B between left cover 102 and back cover 103, a boundary C between back cover 103 and right cover 104, and a boundary D between right cover 104 and right cover end leaf 105.

FIG. 1 shows a state wherein the abovementioned boundaries A to D are smoothened out, and FIG. 2 shows a state where paper 100 is folded at the abovementioned boundaries A to D based on the creasing. The creasing is applied to the abovementioned boundaries A to D for the following reason. That is, since a rather thick paper is generally used for a book cover, etc., the book cover, etc., can be fitted onto a main body (a book or other printed matter) readily and in a manner that is pleasing to the eye, by creasing the paper in advance.

Hardware Arrangement

Figure 3:
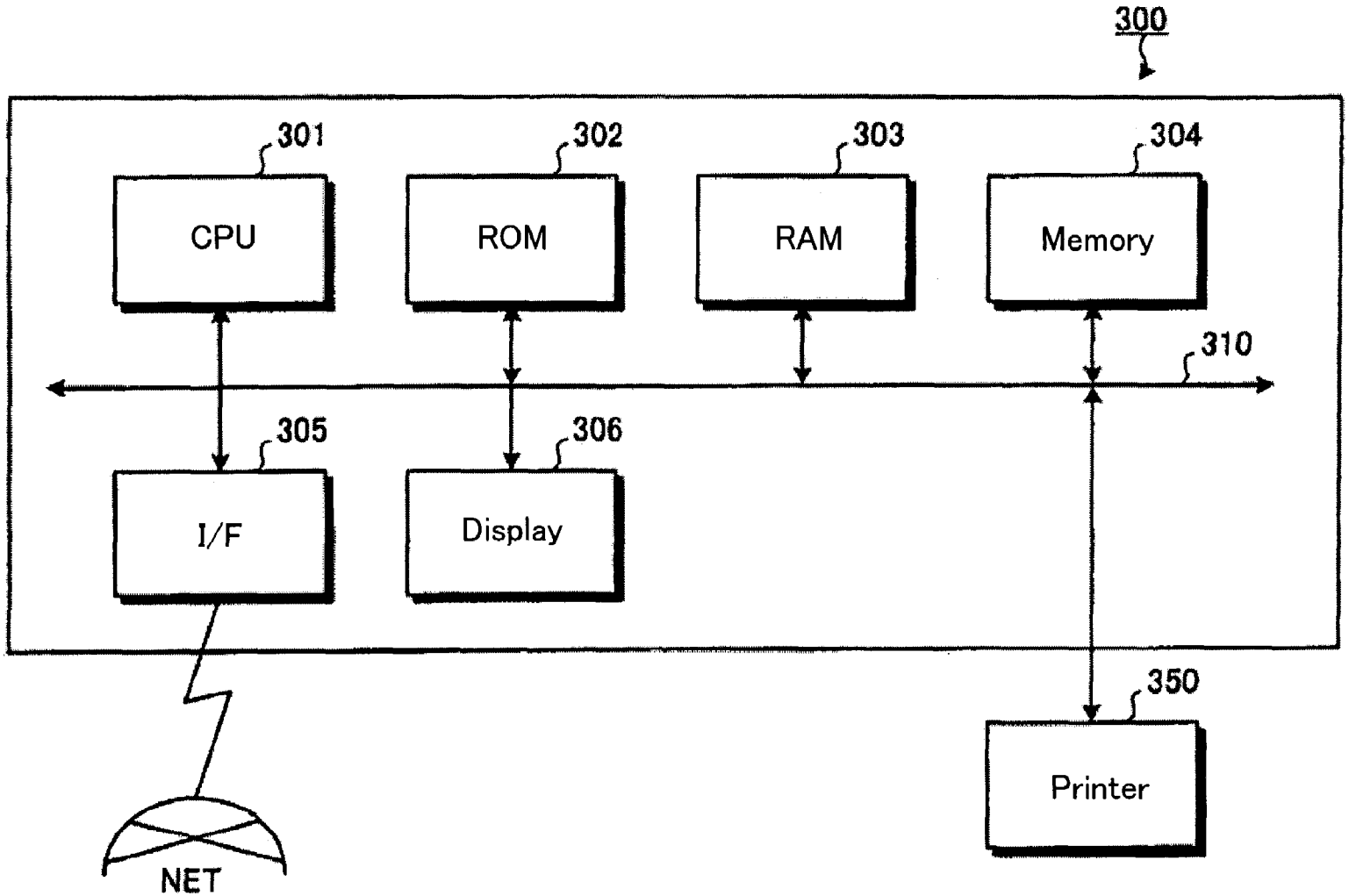
FIG. 3 shows an example of a hardware arrangement that realizes a printing method of the embodiment.

FIG. 3 is an explanatory diagram of an example of a hardware arrangement that realizes a printing method of the embodiment of this invention. In FIG. 3, an information processing device 300, which may be in a form of a personal computer, and a printer 350 connected to the information processing device 300 are shown.

The information processing device 300 includes a CPU 301, a ROM 302, a RAM 303, a memory 304, an interface (I/F) 305, and a display 306. These components 301 to 306 are respectively connected by a bus 310. The printer 350 is also connected to components 301 to 306 via bus 310 and by, for example, a USB.

The CPU 301 executes programs stored in ROM 302, RAM 303, memory 304, etc., to control printing by the printer 350 and control the entirety of the information processing device 300, including control of output (display) of warning information, etc. The ROM 302 stores a basic process program of the information processing device 300. The RAM 303 is used as a working area of the CPU 301. The memory 304 stores various information and is specifically a hard disk (HD), for example. A DVD, compact disk (CD), or other removable storage medium may be used in place of or in addition to the HD.

The I/F 305 is used to send and receive data to and from other information processing devices via a network. Also, other printers may be connected via the network. The display 306 displays characters, images, etc. The display 306 is specifically, for example, a CRT, a liquid crystal display, or a plasma display.

Though the printer 350 may be any of various printers, the invention is especially effective for an inkjet printer, impact printer, or other so-called serial printer with a structure of moving a head in a main scanning direction. The printer 350 can be connected to the information processing device 300 using a USB (Universal Serial Bus) or other interface standard.

Process Procedure

Figure 4:
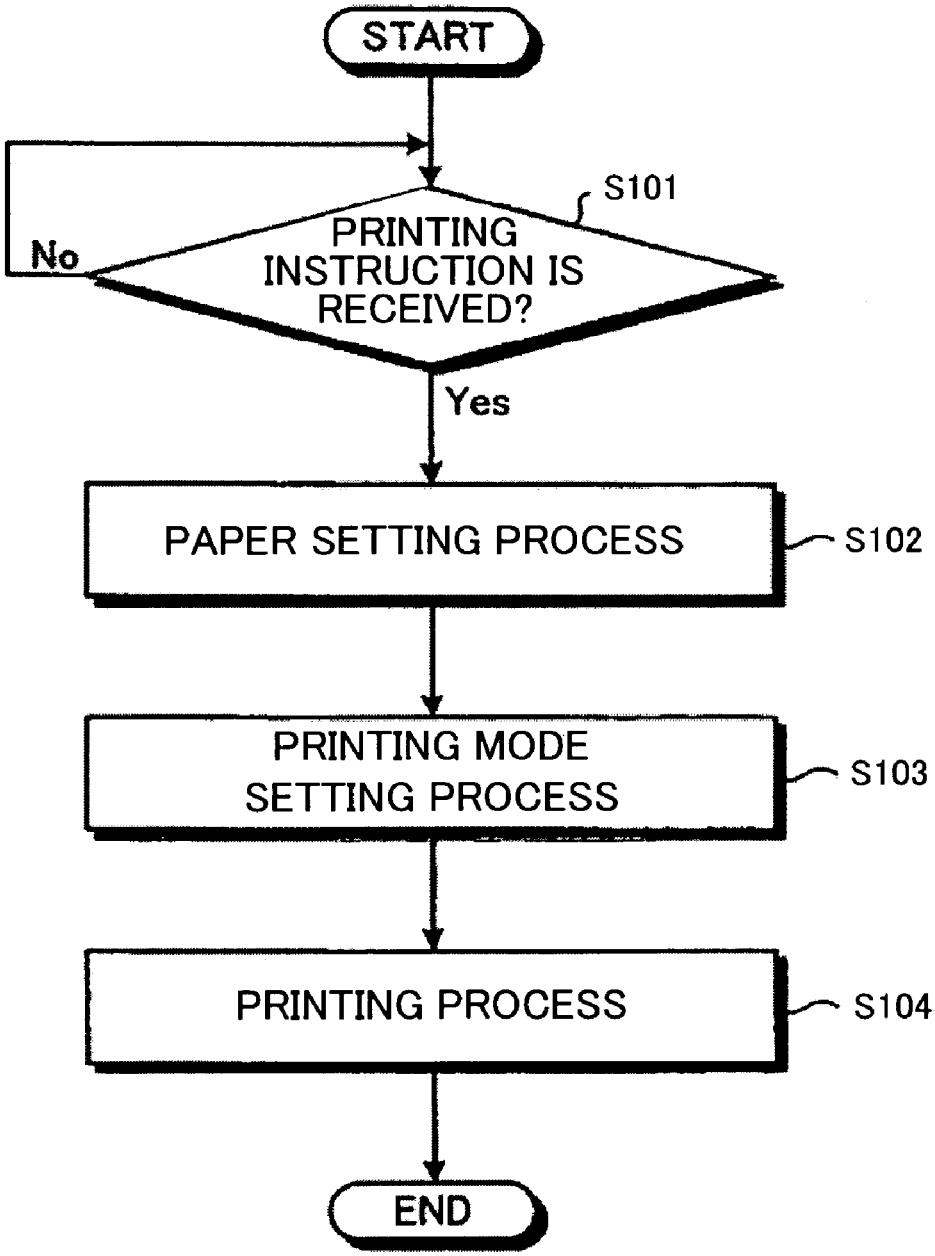
FIG. 4 is a flowchart of a print process performed by the printing method of the embodiment.

FIG. 4 is a flowchart of a print process performed by the printing method of the embodiment of the invention. In the flowchart of FIG. 4, first, the procedure first judges whether or not a print instruction has been received from a user (step S101). The print instruction is awaited here, and when the instruction is received (step S101: Yes), the procedure performs a paper setting process (step S102). Specifically, the procedure judges whether or not a paper is set, and if a paper is not set, displays a message urging the setting of paper (for example, "Please set paper.") on the display screen.

If a paper is set, the procedure performs a printing mode setting process (step S103). The details of the printing mode setting process shall be described later with reference to FIG. 6. After the printing mode setting process ends, the procedure performs a printing process (step S104) and terminates the print process.

Figure 5:
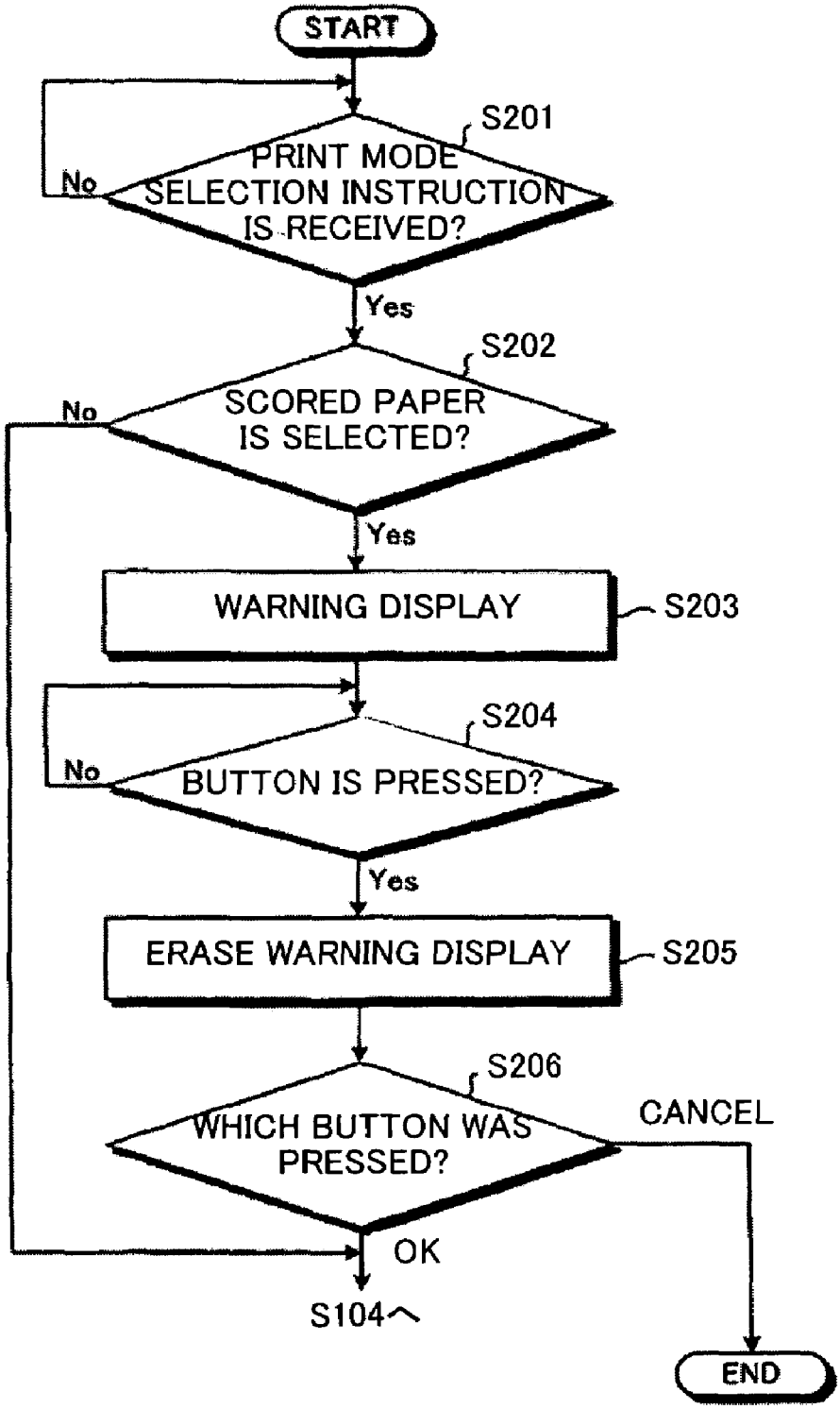
FIG. 5 is a flowchart of a printing mode setting process.

FIG. 5 is a flowchart of the printing mode setting process procedure. In the flowchart of FIG. 5, the procedure first judges whether or not a printing mode selection instruction has been received (step S201). Here, the printing mode selection instruction is awaited and when the instruction is received (step S201: Yes), the procedure judges whether creased paper is selected from among the printing mode selection (step S202). If creased paper is not selected, that is, if normal paper, etc., is selected (step S202: No), the procedure jumps to step S104 of the print process shown in FIG. 4, without performing anything.

If creased paper is selected in step S202 (step S202: Yes), the procedure displays a warning display (step S203). As the warning display here, a message dialog 600 shown in FIG. 6 may be displayed on the display screen.

Figure 6:
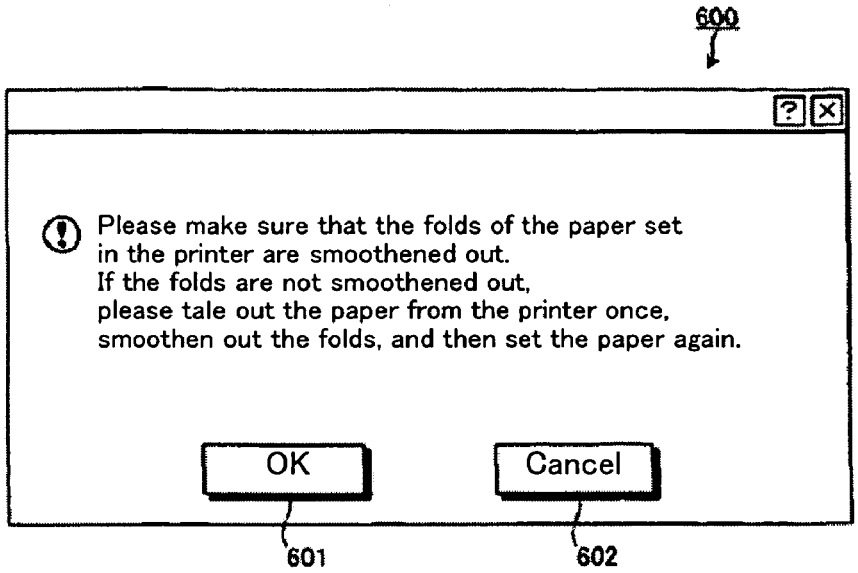
FIG. 6 shows an example of a warning display.

FIG. 6 shows an example of the warning display. As shown in FIG. 6, the message dialog 600 displays a warning that says, for example, "Please make sure that the folds of the paper set in the printer are smoothened out. If the folds are not smoothened out, please take out the paper from the printer once, smoothen out the folds, and then set the paper again.", and includes an "OK" button 601 and a "Cancel" button 602.

The warning shown in FIG. 6 is just one example, and any form (including an illustration or animation) may be used as long as the contents warn that the folds of the paper 100 should be smoothened out. Also a predetermined warning sound or audio message may be output in place of or in addition to displaying the warning.

Returning now to FIG. 5, the procedure of the printing mode setting process subsequently judges, whether or not a button, that is the "OK" button 601 or the "Cancel" button 602 has been pressed (step S204). The pressing of either button is awaited and when a button is pressed (step S204: Yes), the procedure erase the warning display, that is, the display of the message dialog 600 (step S205). In other words, message dialog continues to be displayed without being erased, until either button is pressed. The user is thereby urged to confirm the setting of the paper definitely.

The procedure then determines which of the buttons between the "OK" button 601 and the "Cancel" button 602 has been pressed (step 506). If "OK" button 601 has been pressed, (step S206: OK),the procedure determines that paper 100 is set appropriately and goes on to step S104 of the print process FIG. 4 and the printing process is executed.

If "Cancel" button 602 has been pressed (step S206: Cancel), on the other hand, the procedure determines that the printing is to be canceled and terminates the printing mode setting process with out executing the printing process (step S104 of FIG. 4).

As described above, in the above embodiment of the invention, the course of executing printing onto a creased paper includes a warning step (step S203 of FIG. 5) of warning that the folds are to be smoothened out and a printing step (step S104 of FIG. 4) of starting printing after the warning is given in the warning step. In this structure, whether the paper is set appropriately can be confirmed before printing is started, and thus preventing the feeding of the paper with the folds being folded in printing onto creased paper.

Desired images can thus be printed without fail on a creased paper. In addition, the lowering of printing quality due to head rubbing and damaging of the head itself by a folded paper can be prevented.

In the above embodiment, a reception step (steps S204 and S206 of FIG. 5) of receiving the confirmation instruction with respect to the warning given in the warning step (step S203 of FIG. 5) is included and printing is not started in the printing step until after the confirmation instruction is received in the reception step. This structure also assures to prevent the feeding of paper with the folds being folded when printing onto a creased paper. Such a creased paper is suitable as a cover for printed matter, for example, a book cover made of rather thick paper.

The printing method and the printing program of the invention are also suited for printing onto a book cover, which is for covering a bound album, etc., and is included in a bookbinding kit for preparing an original album, etc., by editing and binding photograph images, etc., printed by a printer.

The printing method of the embodiment maybe also actualized in a form of a computer-readable program that has been prepared in advance, and is realized by executing the program by a computer such as a server or other personal computer or workstation. This program is recorded in a computer-readable recording medium such as an HD, FD, CD-ROM, MO, or DVD and is executed upon being read from the recording medium. The program may also be a transmission medium that can be distributed via a network such as the internet.

Second Embodiment

The construction of a second embodiment of the invention is the same as that of the first embodiment with respect to structure of the creased paper and the hardware arrangement. The second embodiment differs from the first embodiment with respect to a print process, which shall be described in detail below.

Process Procedure

Figure 7:
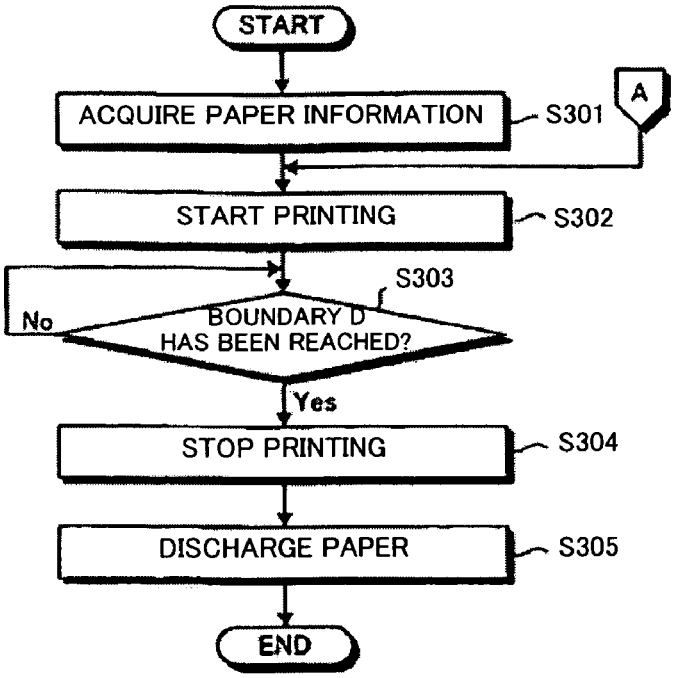
FIG. 7 is a flowchart of a print process performed by a printing method of a second embodiment of the invention.

FIG. 7 is a flowchart of a print process performed by a printing method of the second embodiment. As shown in the flowchart of FIG. 7, the procedure of the print process first acquires paper information on paper 100 that is set (step S301). Here, the paper information include information on positions (distances from a paper end) at which creasing has been performed, that is specifically, information concerning the positions of the boundaries A to D shown in FIG. 1. The paper information may be acquired, for example, by input of a paper type and other information by a user.

The procedure then starts printing (step S302). Printing proceeds in a longitudinal direction of paper 100 and the procedure judges whether or not the boundaries A, B and C and the boundary D has been reached (step S303). The procedure judges whether or not boundary D has been reached based on the information concerning the position of the boundary D (information concerning the distance from the paper end (end portion of left cover end leaf 101) to the boundary D) among the paper information acquired in step S301.

Figure 8:
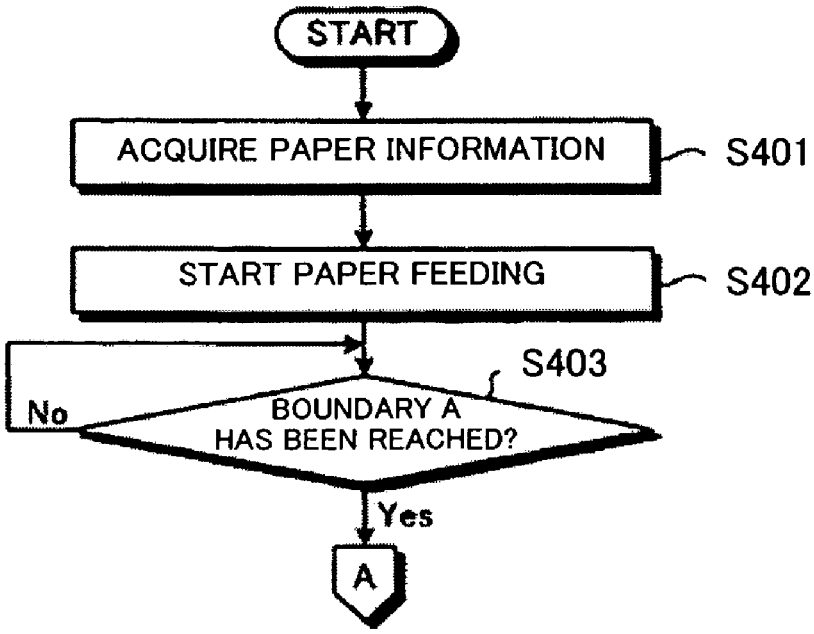
FIG. 8 is a flowchart of a print process performed by the printing method of the second embodiment.

Here, reaching boundary D is awaited and when boundary D is reached (step S303: Yes), the procedure stops printing (step S304). Printing may be stopped even if printing data remain, that is, even if there are printing data for the range of right cover end leaf 105. The procedure discharges the paper 100, using an unillustrated paper feeding mechanism, and terminates the print process FIG. 8 is a flowchart of a part of the modified print process performed by the printing method of the second embodiment of the invention. Whereas printing was performed in the range of the left cover end leaf 101 in the print process of FIG. 7, FIG. 8 shows a print process that avoids performing printing in the range of the right cover end leaf 105 as well as in the range of the left cover end leaf 101.

As shown in the flowchart of FIG. 8, the procedure first acquires, in the same manner as in step S301 of FIG. 7, paper information on the paper 100 that is set (step S401). Here, the paper information include information on the respective positions (distances from a paper end) at which creasing has been performed, that is specifically, information concerning the positions of the boundaries A to D shown in FIG. 1.

The procedure then starts paper feeding (step S402). The paper feeding proceeds in a longitudinal direction of the paper 100, the procedure judges whether or not the boundary A has been reached (step S403), based on the information concerning the position of the boundary A (information concerning the distance from the paper end (end portion of the left cover end leaf 101) to boundary A) among the paper information acquired in step S401.

Here, reaching boundary A is awaited and when boundary A is reached (step S403: Yes), the procedure goes on to step S302 of the print process shown in FIG. 7. Thereafter, the later steps as that described with FIG. 7 is performed.

Figure 9:
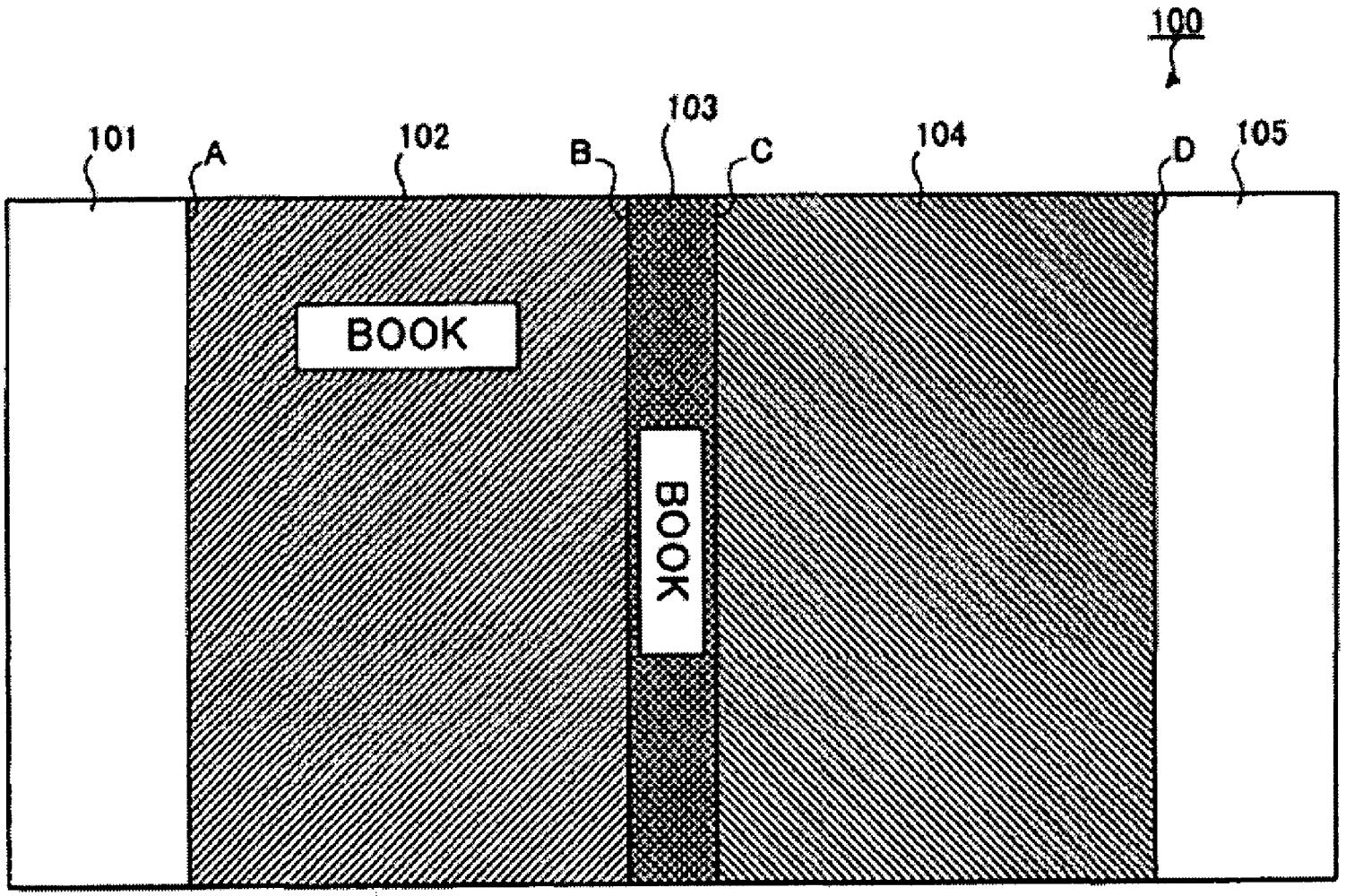
FIG. 9 shows an example of printing onto a paper.

FIG. 9 is an explanatory diagram of an example of printing onto a paper. As shown in FIG. 9, printing is not performed in a range of the right cover end leaf 105. Likewise, printing is not performed in a range of the left cover end leaf 101. However, since the left cover end leaf 101 and the right cover end leaf 105 are portions that become hidden when the book cover is fitted onto a bound printed matter, there is no problem even if printing is not performed on these portions.

As described above, the print process in the second embodiment of the invention includes, in a course of printing onto creased paper, an acquiring step of acquiring information on the creasing of the paper (step S301, step S401), a printing step of starting printing onto the paper and stopping the printing at a predetermined creased position (referred to hereinafter as the "first position") based on the information acquired in the acquiring step (step S301, step S401), and a paper discharging step of discharging the paper (step S305). This structure allows for printing on a creased paper, using a printer that prohibits printing across a range beyond that of regular paper as a specification.

In the second embodiment of the invention, the creased paper is a cover for printed matter that has the left cover end leaf 101, the left cover 102, the back cover 103, the right cover 104, and the right cover end leaf 105 and the first position is the boundary D between the right cover 104 and the right cover end leaf 105 of the paper 100. Printing onto the cover for printed matter can be performed using a general printer, and in this process, printing can be performed at least on the left cover 102, the back cover 103, and the right cover 104.

The print process of the above second embodiment of the invention includes a paper feeding step (step S402) of feeding paper to a predetermined creased position (referred to hereinafter as the "second position") based on the information acquired in the acquiring step, and printing is started after the paper feeding is performed in the abovementioned paper feeding step. This structure avoids performing printing in a range at the front side (for example, the left cover end leaf 101) of the paper feeding direction in correspondence to a non-printed range at the rear side (for example, the right cover end leaf 105) in the paper feeding direction.

In the second embodiment of the invention, the creased paper is a cover for printed matter that includes the left cover the end leaf 101, the left cover 102, the back cover 103, the right cover 104, and the right cover end leaf 105, and the second position is the boundary A between the left cover end leaf 101 and the left cover 102 of paper 100. Printing onto the cover for printed matter can be performed using a general printer, at least on the left cover 102, the back cover 103, and the right cover 104. Such a creased paper is suitable as a cover for printed matter, for example, a book cover made of rather thick paper.

In the second embodiment, printing is stopped at a fold portion. However, printing of the respective ranges of the left cover end leaf 101 and the right cover end leaf 105 may be prohibited by limiting printing area in editing printing condition, according to the type of printer. In this case, since printing data does not exist for the left cover end leaf 101 and the right cover end leaf 105, printing is stopped at the corresponding boundary positions without recognition of the fold portions (boundaries).

In the second embodiment, printing is performed in the direction from the left cover end leaf 101 side to the right cover end leaf 105 side. Printing may instead be performed in the opposite direction, that is, from the right cover end leaf 105 side to the left cover end leaf 101 side. In this case, the position at which printing is started and the position at which printing is stopped are reversed accordingly.

The printing method and the printing program of the invention are also suited for printing onto a book cover, which is for covering a bound album, etc., and is included in a bookbinding kit for preparing an original album, etc., by editing and binding photograph images, etc., printed by a printer.

The printing method of the embodiment may be also actualized in a form of a computer-readable program that has been prepared in advance, and is realized by executing the program by a computer such as a server or other personal computer or workstation. This program is recorded in a computer-readable recording medium such as an HD, FD, CD-ROM, MO, or DVD and is executed upon being read from the recording medium. The program may also be a transmission medium that can be distributed via a network such as the internet.

Third Embodiment

The construction of a third embodiment of the invention is the same as that of the first embodiment with respect to structure of the creased paper and the hardware arrangement.

The third embodiment differs from the first embodiment with respect to a print process, which shall be described in detail below.

Process Procedure

Figure 10:
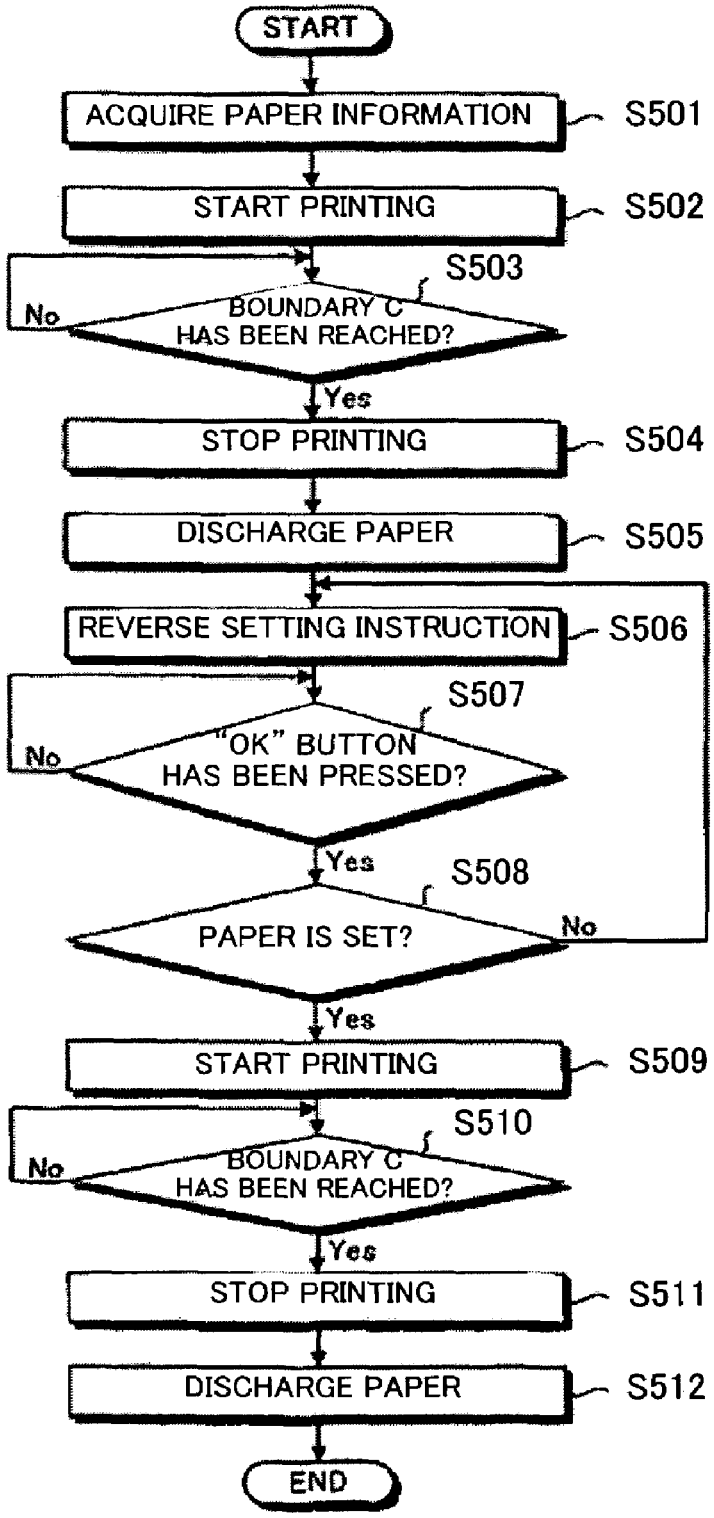
FIG. 10 is a flowchart of a print process performed by a printing method of the second embodiment.

FIG. 10 is a flowchart of a print process performed by a printing method of the third embodiment of the invention. As shown in the flowchart of FIG. 10, the procedure of the print process of the third embodiment first acquires paper information on paper 100 that is set (step S501). Here, the paper information include information on positions (distances from a paper end) at which creasing has been performed, that is specifically, information concerning the positions of the boundaries A to D shown in FIG. 1. The paper information may be acquired, for example, by input of a paper type and other information by a user.

The procedure subsequently starts printing (step S502). Printing proceeds in a longitudinal direction of the paper 100 and the procedure judges whether or not the boundaries A and B have been passed and the boundary C has been reached (step S503). Whether or not boundary C has been reached is judged based on the information concerning the position of the boundary C (information concerning the distance from the paper end (end portion of the left cover end leaf 101) to the boundary C) among the paper information acquired in step S501.

Here, reaching boundary C is awaited and when boundary C is reached (step S503: Yes), the procedure stops printing (step S504), and discharges the paper 100, using the unillustrated paper feeding mechanism (step S505).

Figure 11:
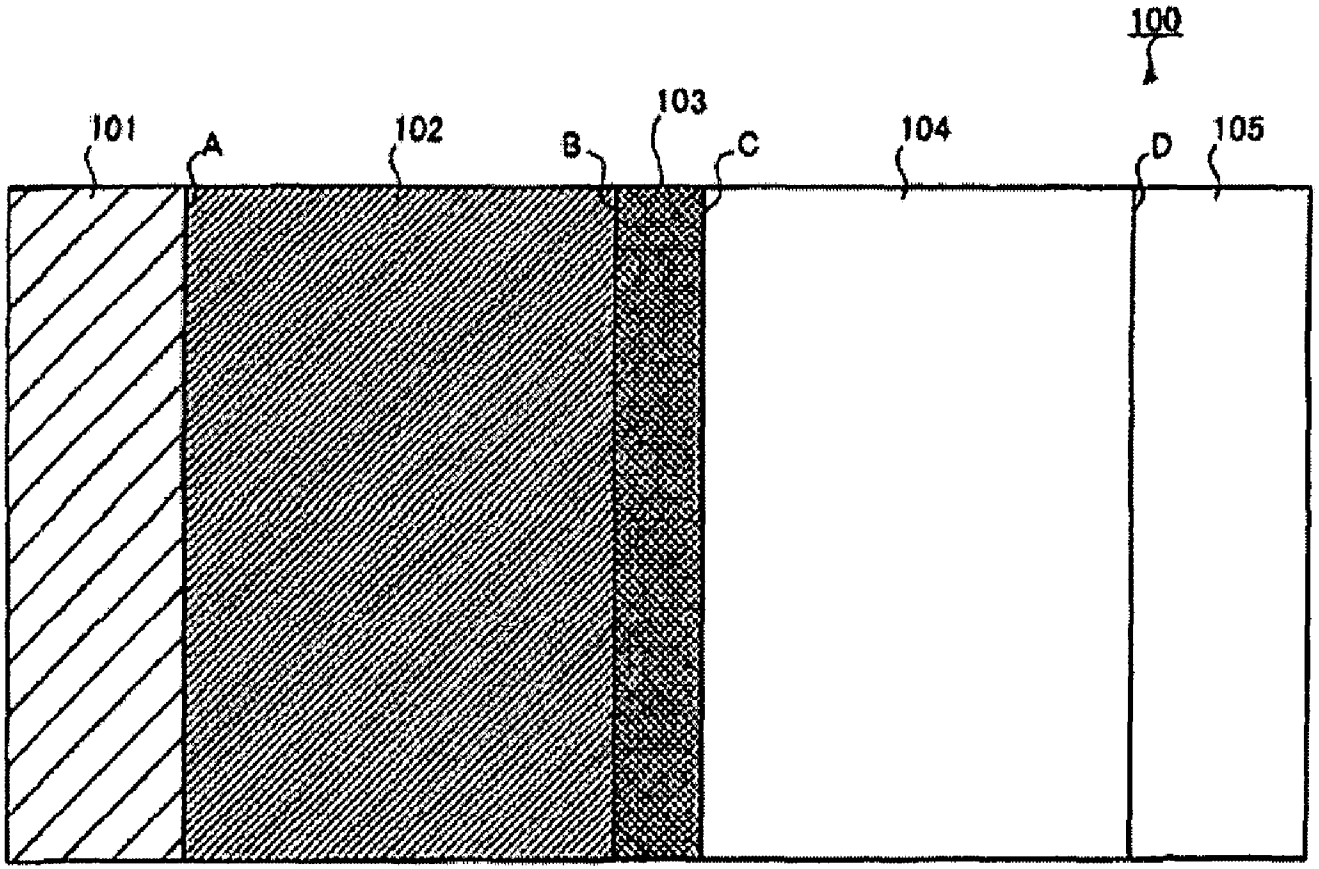
FIG. 11 shows an example of printing onto a paper.

FIG. 11 is an explanatory diagram of an example of printing onto a paper. As shown in FIG. 11, whereas printing is performed on the ranges of the left cover end leaf 101, the left cover 102, and the back cover 103, printing is not performed on the ranges of the right cover 104 and the right cover end leaf 105. In this state, the paper 100 is discharged once from printer 350.

Returning now to FIG. 10, the procedure displays a reverse setting instruction (step S506). Reverse setting refers to the rotating of the plane of the paper 100 by 180° and setting the paper 100 in the printer 350 so that printing is performed from the opposite end of the paper with respect to the paper end at which printing was started formerly (in the first time of printing). In regard to the printing surface, the paper is set so that printing is performed on the same surface as the former (first time of) printing.

Figure 12:
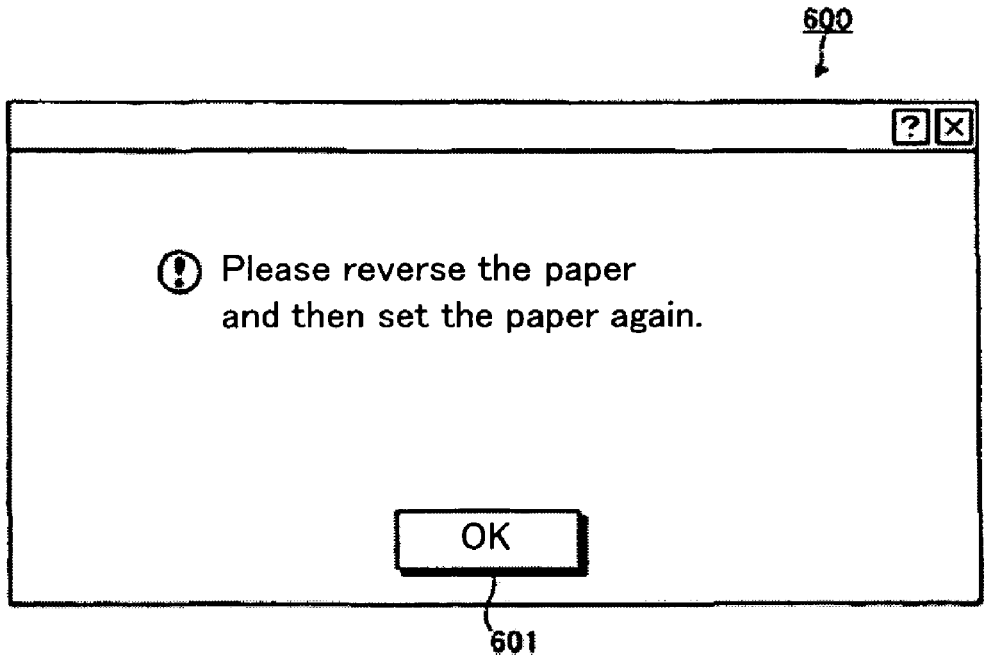
FIG. 12 shows an example of display of a reverse setting instruction.

FIG. 12 is an explanatory diagram of an example of display of the reverse setting instruction. As shown in FIG. 12, the message dialog 600 displays a warning that says, for example, "Please reverse the paper and then set the paper again. ", and includes an "OK" button 601.

The warning shown in FIG. 12 is just one example, and any form (including an illustration or animation) may be used as long as the contents indicates that the paper 100 should be reversed. Also a predetermined warning sound or audio message may be output in place of or in addition to the reverse setting instruction.

Returning now to FIG. 10, the procedure judges whether or not the "OK" button 601 has been pressed (step S507). The pressing of the "OK" button 601 is awaited and when the button is pressed (step S507: Yes), the procedure subsequently judges whether or not the paper 100 has been set correctly (S508). If the paper 100 is not set correctly (step S508: No), the procedure returns to step S506 and displays the reverse setting instruction. The display contents displayed here may differ from those of step S506. For example, "Please check whether the paper has been set accurately." can be displayed as the different display contents.

If the paper 100 is set correctly (step S508: Yes), the procedure restarts printing (step S509). Here, printing is performed upon performing a reversal process (180° rotation process) on the data to be printed accordingly. Printing proceeds in a longitudinal direction of the paper 100 and the procedure judges whether or not the boundary D has been passed and subsequently the boundary C has been reached (step S510). The procedure judges whether or not boundary C has been reached based on the information concerning the position of the boundary C (information concerning the distance from the paper end (end portion of the right cover end leaf 105) to the boundary C) among the paper information acquired in step S501.

Here, reaching boundary C is awaited, and when the boundary C is reached (step S510: Yes) the procedure stops printing (step S511), discharges the paper 100, using the unillustrated paper feeding mechanism (step S512), and terminates the print process.

Figure 13:
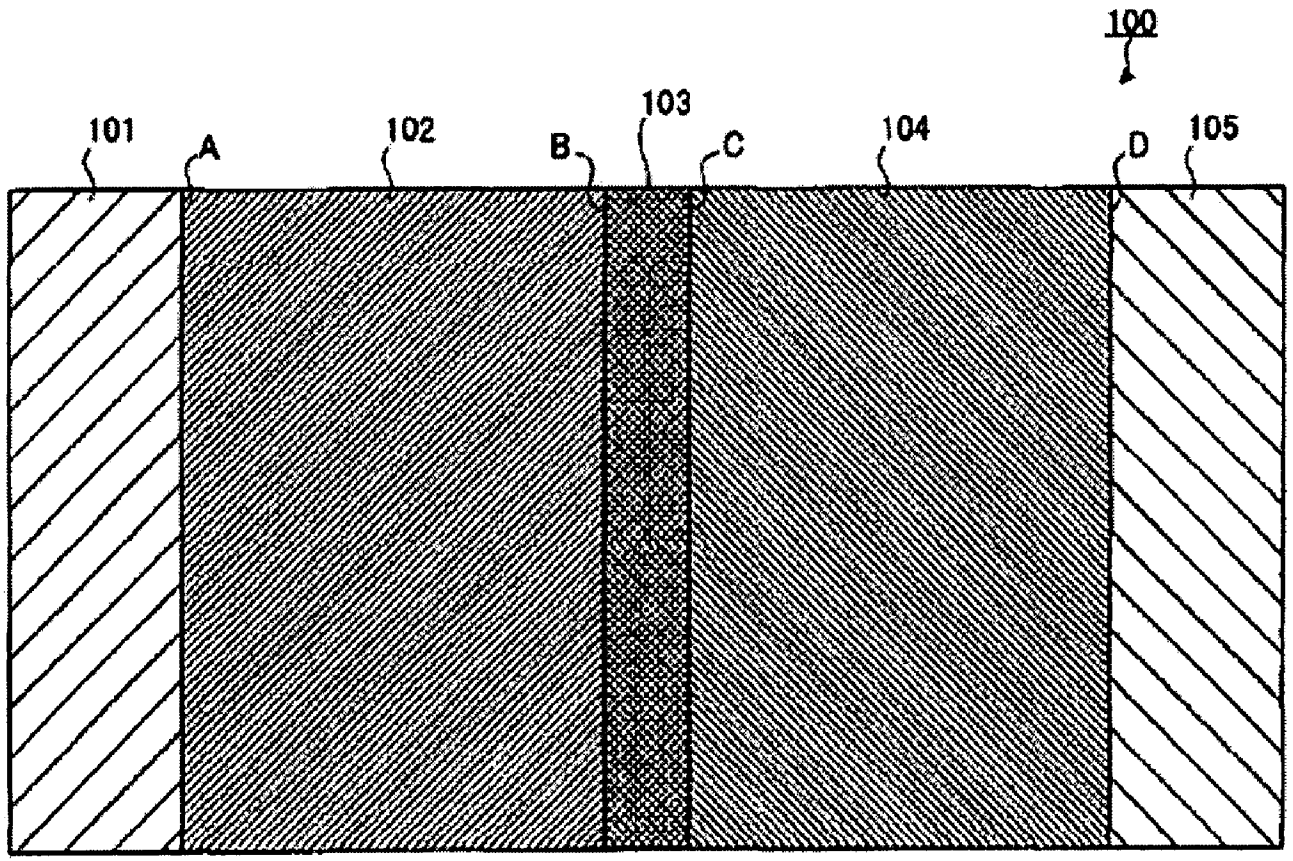
FIG. 13 shows another example of printing onto a paper.

FIG. 13 is an explanatory diagram of another example of printing onto a paper. As shown in FIG. 13, printing is performed in all of the ranges (the respective ranges of the left cover end leaf 101, the left cover 102, the back cover 103, the right cover 104, and the right cover end leaf 105) of the paper 100. Though printing was performed from the opposite side in the second printing with respect to the ranges of the right cover 104 and the right cover end leaf 105, since the data to be printed were printed upon being subject to the reversal process, the vertical orientation of the data is made the same as that of the left cover end leaf 101, the left cover 102, and the back cover 103. It thus appears as if the printing was performed in one step.

In the above process, the printing was divided at the boundary C. The printing may be divided at the boundary B instead of the boundary C. That is, printing on the left cover end leaf 101 and the left cover 102 may be performed in the first printing and printing on the right cover end leaf 105, the right cover 104, and the back cover 103 may be performed in the second printing.

In order to prevent damaging of aesthetic appearance due to overlapping of portions at which printing was divided and forming of unprinted intervals, printing on the left cover end leaf 101 and the left cover 102 may be performed in the first printing and printing on the right cover end leaf 105 and the right cover 104 may be performed in the second printing so that printing is not performed on the back cover 103. Thus, overlapping of printing and forming of unprinted intervals can be prevented. Furthermore, printing of a background may be avoided for the back cover 103. That is, just characters, etc., may be printed.

Figure 14:
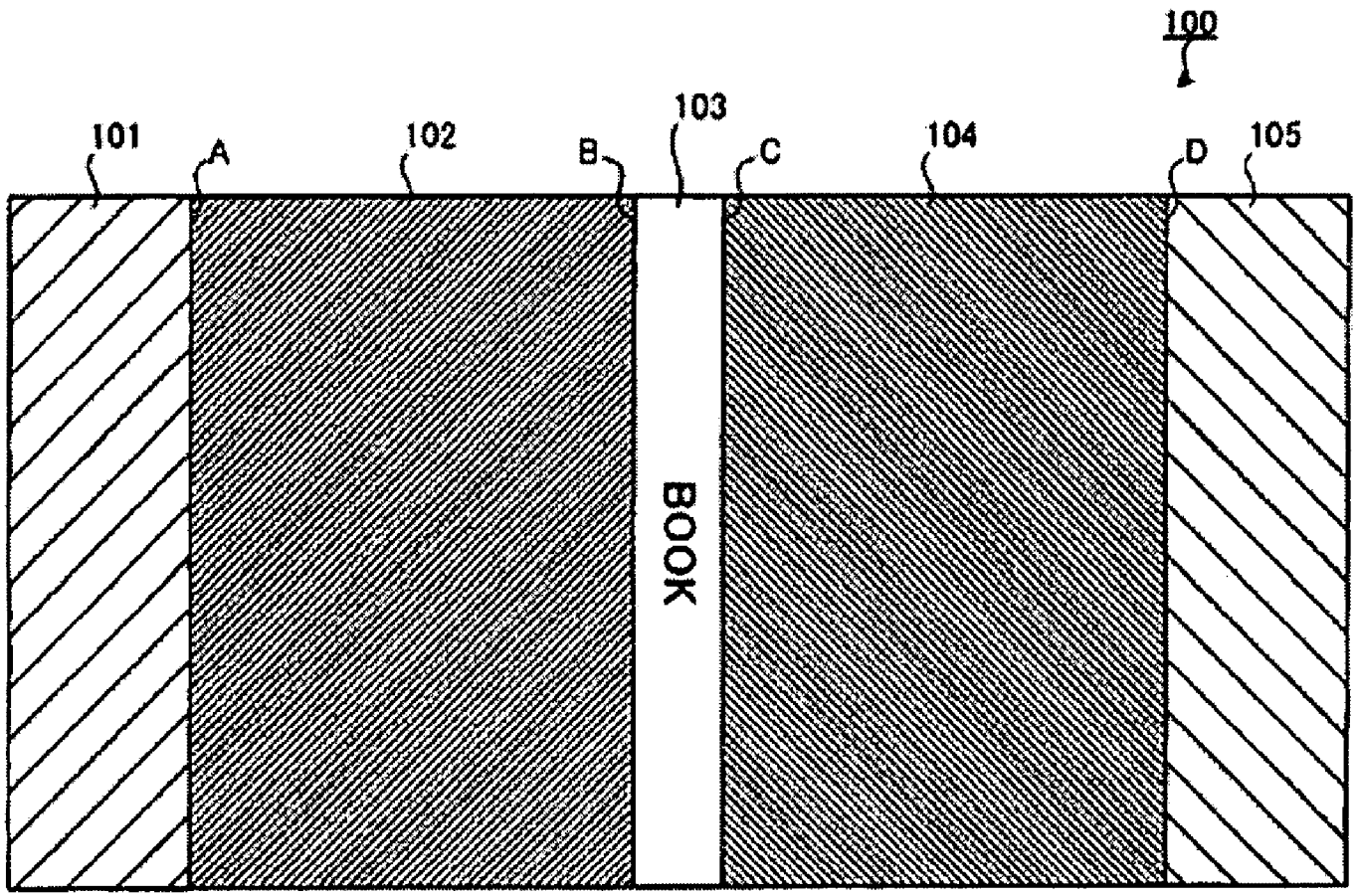
FIG. 14 shows another example of printing onto a paper.

FIG. 14 is an explanatory diagram of another example of printing onto a paper and shows a state where just characters ("BOOK") are printed on the back cover 103, without any background. Thus, overlapping of printing and forming of unprinted intervals can be prevented.

As described above, the print process of the third embodiment of the invention includes an acquiring step of acquiring information on the creasing of the paper 100 (step S501), a first printing step of starting printing onto paper 100 and stopping the printing at a predetermined creased position (referred to hereinafter as the "first position") based on the information acquired in the acquiring step (steps S502 to S504), a first paper discharging step of discharging the paper 100 (step S505), a second printing step of starting printing onto the paper 100 that is set in reverse and stopping the printing at a predetermined creased position (referred to hereinafter as the "second position") based on the information acquired in the acquiring step (steps S509 to S511), and a second paper discharging step of discharging the paper 100 (step S512). This structure allows for printing even on paper that is long in the longitudinal direction, using a printer.

In the third embodiment, the process includes a notifying step (step S506) of notifying the reverse setting of the paper before printing by the second printing step is started. A user can thus be urged to perform the reverse setting of the paper 100.

In the third embodiment of the invention, the creased paper 100 is a cover for printed matter that has the left cover end leaf 101, the left cover 102, the back cover 103, the right cover 104, and the right cover end leaf 105. The first position is the boundary between the left cover 102 and the back cover 103 of the paper 100, and the second position is the boundary between the right cover 104 and the back cover 103 of the paper 100. Printing on a cover for printed matter can be performed using a general printer.

In the third embodiment of the invention, the first position and the second position are the same position. Printing can be performed without gaps on a cover for printed matter. Such a creased paper that is used in the embodiment is suitable as a cover for printed matter, for example, a book cover made of rather thick paper.

In the third embodiment, printing is performed in the direction from the left cover end leaf 101 side to the right cover end leaf 105 side. Printing may instead be performed in the opposite direction, that is, from the right cover end leaf 105 side to the left cover end leaf 101 side. In this case, the position at which printing is started and the position at which printing is stopped are reversed accordingly.

The printing method and printing program of the present invention are also suited for printing onto a book cover, which is for covering a bound album, etc., and is included in a bookbinding kit for preparing an original album, etc., by editing and binding photograph images, etc., printed by a printer.

The printing method of the embodiment may be also actualized in a form of a computer-readable program that has been prepared in advance, and is realized by executing the program by a computer such as a server or other personal computer or workstation. This program is recorded in a computer-readable recording medium such as an HD, FD, CD-ROM, MO, or DVD and is executed upon being read from the recording medium. The program may also be a transmission medium that can be distributed via a network such as the internet.

The present invention claims priority from Japanese Patent Application No. 2005-041749 filed on Feb. 18, 2005, Japanese Patent Application No. 2005-041750 filed on Feb. 18, 2005, and Japanese Patent Application No. 2005-041751 filed on Feb. 18, 2005, and contents of all the three applications are incorporated herein by reference.

What is claimed is:

1. A printing method of printing onto a creased paper with a fold portion, comprising:

an acquiring step that acquires information concerning the creasing of the creased paper;

a first printing step that starts printing onto the paper and stops the printing at a first predetermined creased position based on the information acquired in the acquiring step;

a first paper discharging step that discharges the paper;

a second printing step that starts printing on the paper which is set in reverse after the paper is discharged in the first paper discharging step and stops the printing at a second predetermined creased position based on the information acquired in the acquiring step; and a second paper discharging step that discharges the paper; wherein the second printing step prints remaining data, which have not been printed in the first printing step, after the remaining data are subject to a reversal process of a 180° rotation.

2. The printing method according to claim 1, further comprising:

a notifying step that notifies the need of reverse setting of the paper prior to the starting of printing by the second printing step.

3. The printing method according to claim 1, wherein the creased paper is a cover for printed matter and has a left cover end leaf, a left cover, a back cover, a right cover, and a right cover end leaf, and the first predetermined creased position is a boundary between the left (or right) cover and the back cover of the paper and the second predetermined creased position is a boundary between the right (or left) cover and the back cover of the paper.

4. The printing method according to claim 1, wherein the first predetermined creased position and the second predetermined creased position are the same position.

5. The printing method according to claim 4, wherein the creased paper is a cover for printed matter and has a left cover end leaf, a left cover, a back cover, a right cover, and a right cover end leaf, and the first predetermined creased position is a boundary between the left (or right) cover and the back cover of the paper.

* * * * *